US007002305B2

(12) United States Patent
Kambara et al.

(10) Patent No.: US 7,002,305 B2
(45) Date of Patent: Feb. 21, 2006

(54) ELECTRONIC BALLAST FOR A DISCHARGE LAMP

(75) Inventors: Takashi Kambara, Ikeda (JP); Toshifumi Tanaka, Katano (JP)

(73) Assignee: Matsushita Electric Works, Ltd., Osaka (JP)

( * ) Notice: Subject to any disclaimer, the term of this patent is extended or adjusted under 35 U.S.C. 154(b) by 46 days.

(21) Appl. No.: 10/493,824

(22) PCT Filed: Sep. 25, 2003

(86) PCT No.: PCT/JP03/12227

§ 371 (c)(1),
(2), (4) Date: Apr. 28, 2004

(87) PCT Pub. No.: WO2004/030420

PCT Pub. Date: Apr. 8, 2004

(65) Prior Publication Data

US 2004/0251852 A1 Dec. 16, 2004

(30) Foreign Application Priority Data

Sep. 25, 2002 (JP) ..... 2002-279980
Jun. 27, 2003 (JP) ..... 2003-185856

(51) Int. Cl.
*G05F 1/00* (2006.01)

(52) U.S. Cl. ..... 315/291; 315/307; 315/308; 315/224; 315/360

(58) Field of Classification Search ..... 315/224, 315/225, 291, 307, 219, 209 R, DIG. 4, DIG. 5, 315/308, 360
See application file for complete search history.

(56) References Cited

U.S. PATENT DOCUMENTS

| | | | | |
|---|---|---|---|---|
| 5,103,143 | A | 4/1992 | Daub | |
| 5,212,428 | A | 5/1993 | Sasaki et al. | |
| 6,693,393 | B1 * | 2/2004 | Konishi et al. | 315/224 |
| 2003/0160576 | A1 * | 8/2003 | Suzuki | 315/291 |

FOREIGN PATENT DOCUMENTS

| | | | |
|---|---|---|---|
| EP | 0 483 082 | A3 | 4/1992 |
| EP | 0 536 535 | A1 | 4/1993 |
| JP | 07-065982 | A1 | 3/1995 |
| JP | 08-330089 | A1 | 12/1996 |
| JP | 2946384 | B2 | 7/1999 |

OTHER PUBLICATIONS

International Search Report for PCT/JP03/12227 mailed on Jan. 27, 2004.

* cited by examiner

*Primary Examiner*—Thuy V. Tran
*Assistant Examiner*—Marie Antoinette Cabucos
(74) *Attorney, Agent, or Firm*—Rader, Fishman & Grauer PLLC

(57) ABSTRACT

An electronic ballast for a discharge lamp has a controller that increase luminous flux of the lamp to a stabilized level in a constant time irrespective of possible variations in lamp characteristic. The controller utilizes a reference lamp power table and a reference lamp voltage table respectively defining a reference lamp power and a reference voltage varying with time. The controller includes a voltage deviation detector that gives a voltage correction index indicating a voltage deviation between the reference voltage and a monitored lamp voltage. The voltage correction index is processed at an offset provider that gives an offset power. A target power generator is included to correct the reference lamp power in view of the offset power, thereby generating a target lamp power which is constantly updated and is supplied to the lamp.

18 Claims, 11 Drawing Sheets

Pref
Reference Lamp Power
time

Lumininous Flux
α
β
γ
time

Vs
Vref (α)
β
γ
time

PCR = ∑(ΔVs−ΔVref)
β
α
γ
time

POF
POF = f{∑(ΔVs−ΔVref)}
β
α
γ
time

PTG
α
γ
β
T1
T2
T3
time

FIG. 4
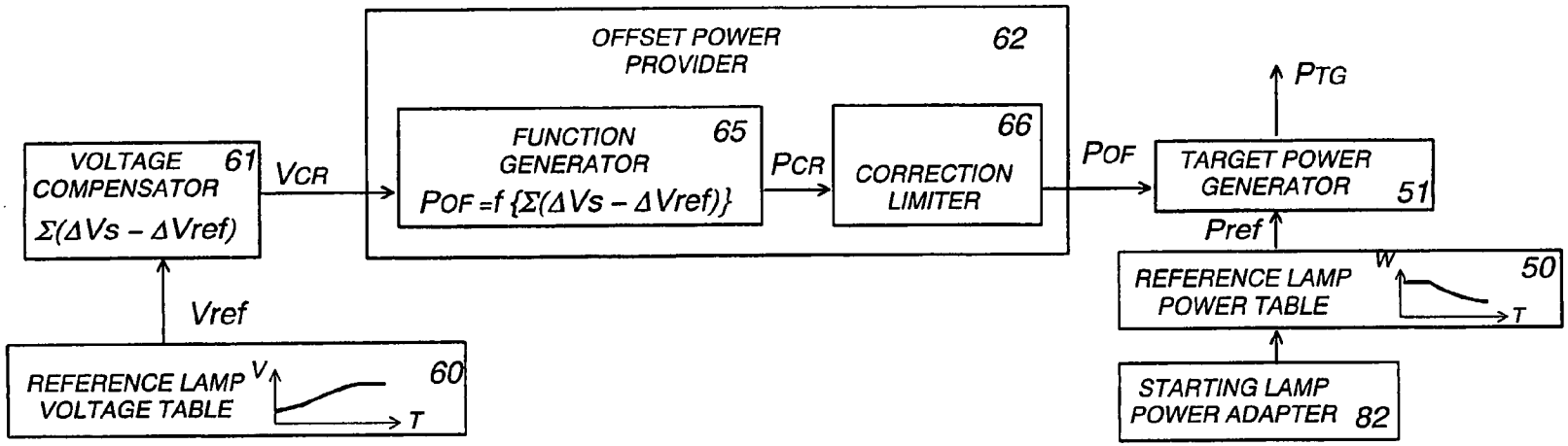
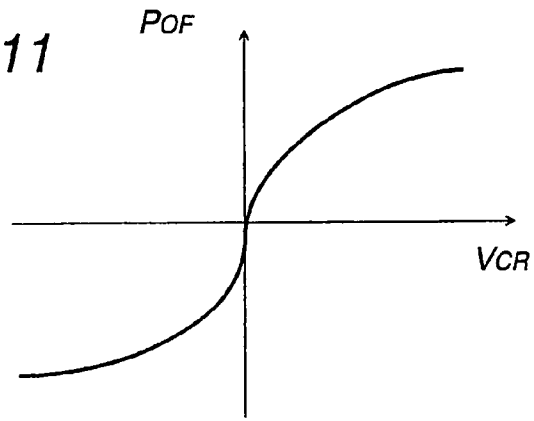
FIG. 11

$P_{CR} = \sum(\Delta Vs - \Delta Vref)$ $P_{OF} = f\{\sum(\Delta Vs - \Delta Vref)\}$

ELECTRONIC BALLAST FOR A DISCHARGE LAMP

TECHNICAL FIELD

The present invention relates to an electronic ballast for a discharge lamp, more particularly, a high intensity discharge lamp, for example, a metal halide lamp utilized as an automobile's head lamp and a projector lamp.

BACKGROUND ART

High intensity discharge lamps have been now utilized as automobile's head lamp and a projector lamp. Because of the nature of this application, the lamps have to increase luminous flux rapidly upon being turned on. Particularly, the automobile's lamps have to satisfy a requirement of increasing the luminous flux to a sufficiently high level within a few seconds. When designing the ballast that ensures a rapid increase of the luminous flux, it should be taken into consideration that a possible variation in lamp characteristic may bring about an appreciable delay in reaching a prescribed light output level due to overshooting or undershooting of the light output.

Japanese Patent Publication No. 2946384 discloses a ballast that is intended to compensate for the lamp characteristic variation in an attempt to increase the light output to a sufficiently high level without a delay. The ballast monitors the voltage being applied to the lamp and controls the output power in accordance with a specific change in the monitored voltage. The output power, which is corrected by the monitored voltage, is set by an analog circuit to vary with respect to time from a large wattage starting condition to a steady-state constant wattage condition. However, the prior ballast is found not to be sufficiently satisfactory for correcting the output power in exact reflectance of the monitored condition of the lamp, because of that the output power is caused to vary only with some delay due to a time constant inherent to the analog circuit, and therefore not in an exact match with the lamp characteristic given in a transition period from the lamp starting condition to the steady-state condition, and also because of that the target output power to be subsequently given is only determined based upon the current output power and not from the expected output power at the subsequent time.

DISCLOSURE OF THE INVENTION

In view of the above insufficiency, the present invention has been accomplished to provide an electronic ballast for a discharge lamp which is capable of starting and leading the lamp successfully into the steady-state condition only through a constant time period irrespective of possible variations in a lamp characteristic. The ballast in accordance with the present invention includes a power converter that provides a regulated output power for operating the discharge lamp, a lamp voltage monitor that monitors a lamp voltage being applied to the lamp, a lamp current monitor that monitors a lamp current being supplied to the lamp, and a controller that regulates the power converter to vary the output power in accordance with the lamp voltage and lamp current being monitored.

The controller is configured to include a lamp voltage table, a voltage deviation detector, an offset power provider, and a lamp power table, a target power generator, and a commander. The lamp voltage table specifies a reference lamp voltage which is applied to the lamp and is defined to vary with respect to an elapsed time from the start of the lamp. The voltage deviation detector derives a voltage-related deviation between the lamp voltage being monitored and the reference voltage corresponding to a time at which the lamp voltage is monitored, and gives a voltage correction index indicative of the deviation. The voltage correction index is fed to the offset power provider where it is processed into an offset power. The lamp power table specifies a reference lamp power which is supplied to the lamp and which is defined to vary with respect to time elapsed from the start of the lamp. The reference lamp power is corrected continuously at the target power generator in view of the offset power. In response to the target lamp power, the commander provides a control command for regulating the output power in match with the target lamp power. The voltage deviation detector updates the voltage correction index over a plurality of times until a luminous flux of the lamp converges to a certain level, and the target power generator updates the target lamp power in correspondence with the updated voltage correction index. Thus, the target lamp power can be constantly updated or corrected in well reflectance of a monitored lamp condition.

Since the tables can determine a standard lamp characteristic expected during the transition period from the lamp starting high power condition to the steady-state constant power condition, it is readily possible to detect an exact deviation of a particular lamp from the standard characteristic and provide as the voltage correction index give for the particular lamp. Consequently, the target lamp power can be given in an exact reflectance of the voltage correction index. In other words, the output power from the ballast can be regulated, i.e., the reference lamp power can be corrected in well coincidence with the lamp characteristic of the lamp. Thus, the output power can be controlled to vary consistently and reliably in order to make smooth transition to the steady-state constant power condition exactly in a prescribed time.

It should be noted in this connection that there has been an increasing demand for utilizing mercury-free high intensity discharge lamp as the automobile's head lamp for sake of reducing environmental load. Such mercury-free discharge lamp has, in addition to xenon as a rare gas, a filling of metal halide such as zinc iodide having relatively high vapor pressure as an alternate filling to mercury. Because of the mercury-free nature, xenon acts predominantly until a lamp temperature reaches to a certain level, thereby necessitating a relatively long rise time for the lamp to attain a sufficient luminous level. Although it might be effective to give an increased lamp power at the start of the lamp for shortening the rise time, such increased lamp power would certainly cause the lamp to increase its luminous flux abruptly some time immediately after the start of the lamp, therefore bringing about undesired overshooting of the luminous flux and eventually delay the time for reaching the stabilized luminous flux. The ballast of the present invention is found advantageous and effective also for operating the mercury-free discharge lamp, as it can take into account of the timing from which the undesired overshooting of the luminous flux would arise and can therefore reduce the lamp power timely for assuring stabilized increase of the luminous flux without causing the overshooting.

In one embodiment of the present invention, the voltage deviation detector is designed to calculate the voltage-related deviation ($\Delta Vs - \Delta Vref$) between a gradient of the monitored lamp voltage ($\Delta Vs$) and a gradient of the reference lamp voltage ($\Delta Vref$) with respect to time, and to obtain the voltage correction index (VCR) which is an integral of the deviation as defined by $VCR=\Sigma_t(\Delta V_S-\Delta Vref)$. In this connection, the offset power provider gives the offset power that is a function of the voltage correction index as expressed by $POF=f\{\Sigma_t(\Delta V_S-\Delta Vref)\}$, and the target power generator generates the target power (PTG) which is the reference lamp power (Pref) minus the offset power (PTG=Pref−POF).

Alternatively, the voltage deviation detector may be designed to give the voltage correction index (VCR) defined by an error voltage (VCR=Vs−Vref) between the monitored lamp voltage and the reference lamp voltage. In this case, the offset power provider gives the offset power that is a function of the voltage correction index as expressed by POF=f{(Vs−Vref)}. Likewise, the target power generator provides the target lamp power (PTG) which is the reference lamp power (Pref) minus the offset power (PTG=Pref−POF).

The controller may have a function of reducing a gradient of the offset power as the voltage correction index increases. Thus, it is possible to avoid undue lowering of the output power which would otherwise result in the extinction of the lamp.

Also, the controller may be designed to reduce the absolute value of the offset power as the time elapsed beyond a predetermined time period from the start of operating the lamp. With the scheme of reducing the offset power after the elapse of the predetermined time period, a consistent control can be made to approach the target lamp power to the reference lamp power gradually but in time for converting the luminous flux to the stabilized level.

Preferably, the controller is made not to increase the output power after the elapse of the predetermined time period within which an intended luminous flux has been already obtained. Thus, no additional increase of the output power is made for avoiding unintended increase of the light output. Otherwise, a slight increase of the output power would result in undue and abrupt increase of the light output.

The controller is preferred to include a limiter that increases the output power up to a rated power when the target lamp power is corrected to be less than the rated lamp power when the target lamp power is corrected to exceed the maximum lamp power. Thus, it is possible to avoid unintended lowering of the output power which would otherwise occur upon being subject to noise. Also, the limiter may be designed to limit the output power below a maximum lamp power when the target lamp power is corrected to exceed the maximum lamp power for avoiding unintended excessive increase of the luminous flux.

Further, the controller may include a correction limiter that limits the offset power from varying beyond a certain extent in order to restrain undue increase or decrease of the output power being supplied to the lamp.

The controller may be designed such that the target power generator is enabled to correct the reference lamp power only after an elapse of a, predetermined time from the start of operating the lamp. The predetermined time is selected to be a time after which the voltage correction index can give a good basis for successfully correcting the reference lamp power.

Instead of using the predetermined time, it may be made to rely upon luminous efficacy as a scale for initiating the lamp power correction. Also for the mercury-free discharge lamp, the luminous efficacy is found to increase even with a decreasing output power after the elapse of a certain time from the very start of operating the lamp. Also, it is found that a change in a parameter indicative of the luminous efficacy after the elapse of the certain time can give a good basis for correcting the lamp power to advance the lamp consistently and smoothly into the steady-state condition in the prescribed time. Thus, for operating the mercury-free discharge lamp, it is particularly advantageous to rely upon the above scheme of determining the timing of initiating the power correction by use of the parameter indicative of the luminous efficacy. Also the above scheme is found effective to increase the luminous flux without a delay even when the maximum lamp power is restricted for the purpose of avoiding chattering of the voltage source as well as protecting the ballast due to the lowering of the input voltage and the excessive temperature increase of the ballast, respectively.

For this purpose, the controller is preferred to include a discriminator which examines a parameter indicative of the luminous efficacy of the lamp and issues a trigger signal when the parameter satisfies a predetermined criterion indicative of that the luminous efficacy increases to a certain level. Upon occurrence of the trigger signal, the target power generator is allowed to correct the reference lamp power.

The parameter may be an integrated lamp power, i.e., the sum of the lamp power being supplied from the start of operating the lamp, or the sum of the target lamp power calculated.

The discriminator may be configured to give a voltage difference between an instantaneous lamp voltage being monitored and a starting lamp voltage monitored at the start of operating the lamp. In this connection, the criterion is set to be whether the voltage difference is greater than a predetermined voltage such that the discriminator issues the trigger signal when the voltage difference exceeds the predetermined voltage.

Alternatively, the discriminator may be configured to give a gradient of the lamp voltage being currently monitored, and the criterion is set to be whether the gradient is greater than a predetermined value such that the discriminator issues the trigger signal when the gradient exceeds the predetermined value.

Still further, the discriminator may include a re-starting adjustor which gives a signal indicative of a downtime starting from the extinction of the lamp. The above predetermined value of the criterion set to decrease with the decreasing downtime. With this arrangement, it is possible to vary the output power adequately in match with different lamp characteristic that the hot lamp exhibits, thereby assuring successful re-starting of the lamp.

These and still other objects and advantageous features of the present invention will become more apparent from the following description of the preferred embodiments when taken in conjunction with the attached drawings.

BRIEF DESCRIPTION OF THE DRAWINGS

FIG. 4 is a block diagram illustrating a portion of the above ballast;

FIG. 11 is a graph illustrating an operation of a modified ballast; and

BEST MODE FOR CARRYING OUT THE INVENTION

Figure 1:
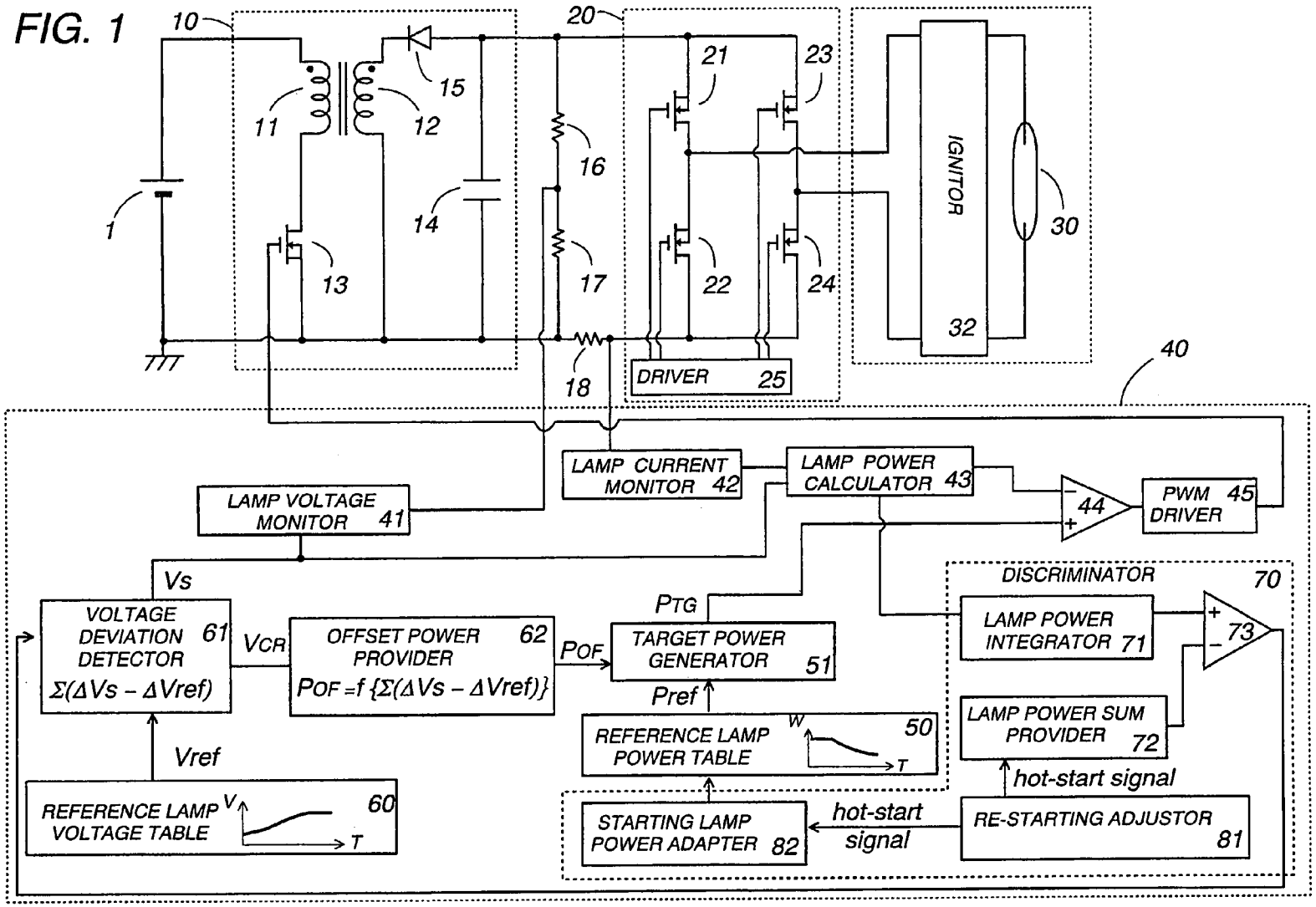
FIG. 1 is a circuit diagram of an electronic ballast in accordance with a first embodiment of the present invention.

Referring now to FIG. 1, there is shown an electronic ballast for operating a gas discharge lamp in accordance with a first embodiment of the present invention. The ballast includes a DC-DC converter 10 providing a regulated DC voltage from a fixed DC voltage source 1, an inverter 20 that receives the regulated DC voltage to give an AC power to a discharge lamp 30, and an ignitor 32 providing a high starting lamp voltage for starting the lamp 30. The converter 10 includes a transformer having a primary winding 11 and a secondary winding 12, and a switching transistor 13 which is connected in series with the primary winding 11 across the DC voltage source 1. A smoothing capacitor 14 is connected in series with a diode 15 across the secondary winding 12 to accumulate the DC voltage. The switching transistor 13 is driven to turn on and off at a varying duty ratio determined by a controller 40 in order to regulate the output DC voltage given to the inverter 20, and therefore a resulting AC power supplied to the lamp 30. The inverter 20 includes four switching transistors 21 to 24 connected in a full-bridge configuration which receives the output DC voltage from the converter 10 to give the output AC power to the lamp 30. A driver 25 is provided to turn on and off simultaneously one pair of diagonally opposed switching transistors 21 and 24 in an alternate relation with the other diagonally opposed pair of switching transistors 22 and 23.

The controller 40 includes a lamp voltage monitor 41 and a lamp current monitor 42 for monitoring a voltage and a current supplied to the inverter 20 as indicative of a lamp voltage and a lamp current in order to recognize a real-time condition of the lamp. The lamp voltage monitor 41 is connected to receive the voltage from a voltage divider composed of resistors 16 and 17 connected across the capacitor 14. The lamp current monitor 42 is connected to receive the voltage across a current-sensing resistor 18. A PWM driver 45 is included in the controller 40 to vary the duty-ratio of the switching transistor 13 of the converter 10 for adjusting the output power being supplied to the lamp 30 continuously in order to supply an adequate amount of the lamp power to the lamp, enabling the lamp to give off sufficient light output in a predefined lamp start time, as will be discussed in detail hereinafter.

Figures 2A, 2B, 2C, 2D, 2E, 2F:
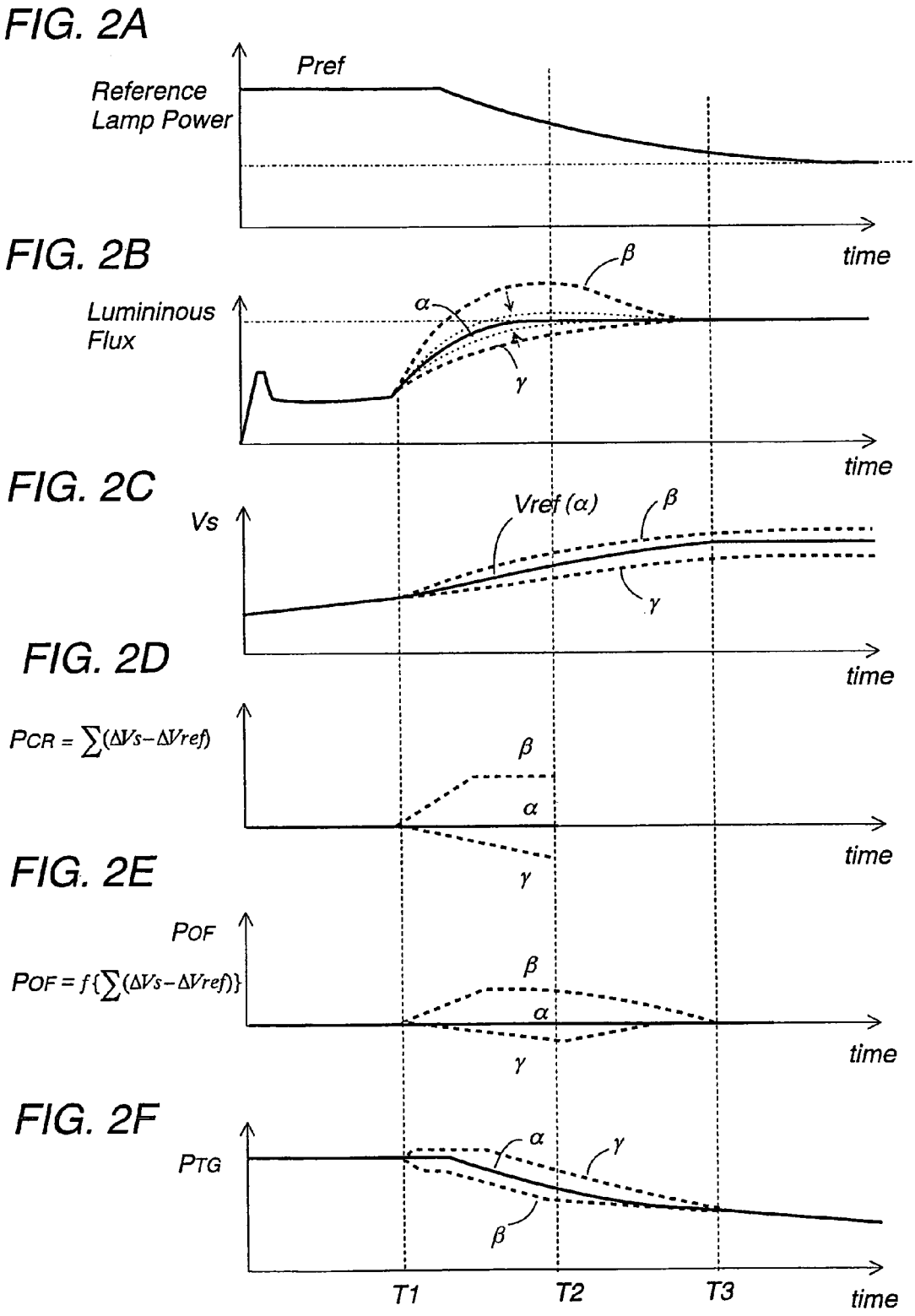
FIGS. 2A to 2F are respectively waveform charts illustrating the operation of the above ballast.

Prior to discussing the details of the controller 40, it is noted that the lamps of the same rated power inherently suffer from a lamp characteristic variation which would cause a delay for the lamp in reaching a predetermined light intensity, i.e., luminous flux from the start of operating the lamp. Particularly when the lamp is utilized as the automobile's head lamp, such delay should be avoided in order to make a driver free from uncertainty. For example, the ballast for such use is preferred to operate the lamp at 25% to 150% of a rated luminous flux at one (1) second, and at 80% to 130% of the rated luminous flux within 1 to 4 seconds from the start of operating the lamp, when the rated luminous flux is defined to be that obtained after the elapse of fifteen (15) minutes. Further, as shown in FIG. 2A, it is known that the lamp 30 requires much power at the very beginning of being started, i.e., ignited, and requires to reduce the power as the lamp advances to its rated condition. When there are seen the lamp characteristic variations among the lamps of the same rated power, the luminous flux will increase along different characteristic curves α, β, and γ, as shown in FIG. 2B. That is, when the lamp power curve of FIG. 2A, which can be termed as a reference lamp power Pref, is selected to be in match with a standard lamp having the characteristic curve α, and the ballast supplies the reference lamp power Pref, the lamps having the characteristics β and γ converge their luminous fluxes to a stabilized level too early or too late. In either case, the stabilized luminous flux is attained only after some delay than that made to the lamp having the characteristic curve α, as shown in FIG. 2B.

In order to avoid the above undesired delay, the present invention is configured to converge the luminous flux to the stabilized level moderately in a fixed time period from the start of supplying the output power to the lamp. In other words, even when the lamp having the characteristic β or γ is supplied with the reference lamp power Pref given to the lamp having the characteristic curve α, the reference lamp power Pref can be suitably corrected or modified such that the luminous flux can increase moderately and converges to the stabilized level in the same time as the curve α does.

The deviation in the manner that the lamps of unmatched characteristic (β or γ) will increase the luminous flux in relation to the lamp of the matched characteristic (α) is found to well reflect on a corresponding deviation between the monitored lamp voltage Vs and a reference lamp voltage Vref that is defined as corresponding to the lamp having the characteristic (α), as shown in FIG. 2C. Based upon the above finding, the controller 40 is designed to correct the reference lamp power Pref in consideration of the deviation of the monitored lamp voltage Vs in relation to the reference lamp voltage Vref. Further, as shown in FIGS. 2A to 2E, the lamp power is continuously corrected during a definite time period T1 to T3, i.e., a transition period between the initial period of supplying the high and constant output power to start increasing the luminous flux of the lamp and a stabilized period of supplying a low and constant output power to keep providing the constant luminous flux.

Turning back to FIG. 1, the controller 40 includes a reference lamp power table 50 and a reference lamp voltage table 60 respectively for storing the reference lamp power Pref and the reference lamp voltage Vref each varying with respect to the elapsed time. A voltage deviation detector 61 is included to calculate a voltage-related deviation ($\Delta V_S - \Delta Vref$) between a gradient of the monitored voltage ($\Delta Vs$) and a-gradient of the reference voltage ($\Delta Vref$) with respect to time, and to obtain a voltage correction index (VCR) which is an integral of the deviation as defined by $VCR = \Sigma_t(\Delta V_S - \Delta Vref)$. Associated with the voltage deviation detector 61 is an offset power provider 62 that gives an offset power POF that is a function of the voltage correction index VCR and expressed by $POF = f\{\Sigma_t(\Delta V_S - \Delta Vref)\}$. The offset power is utilized in a target power generator 51 which is included in the controller 40 to fetch the reference lamp power from the lamp power table 50. The target power generator 51 gives a target lamp power PTG which is the reference lamp power (Pref) minus the offset power (PTG=Pref−POF). The target lamp power PTG is fed to an error amplifier 44 which also receives an instantaneous lamp power obtained at a lamp power calculator 43 as a product of the monitored lamp current and the lamp voltage. The output of the error amplifier 44 is processed at the PWM driver 45 for regulating the output power being actually supplied to the lamp 30 in match with the target lamp power PTG. In this sense, the error amplifier 44 and the PWM driver 45 are cooperative to constitute a commander that provides a control command for regulating the output power in match with the target lamp power. Thus, the reference lamp power Pref is continuously corrected to provide the target lamp power PTG in order to smoothly increase the luminous flux in an intended pattern irrespective of possible variations in the lamp characteristic.

It is noted in this connection that the offset power provider 62 is configured to provide the offset power $POF=f\{\Sigma(\Delta V_S-\Delta Vref)\}$ during the time period T1 to T2, and thereafter reduce an absolute value of the offset power gradually to zero until time T3, as shown in FIG. 2E such that the target power PTG approaches to the reference lamp power Pref, as shown in FIG. 2F. Normally, time T1 and T2 are selected to be 2 seconds and 12 seconds respectively after the lamp start of supplying the output power to the lamp, while T3 is expected to be normally 30 seconds after the lamp start where the lamp is expected to give off the stabilized luminous flux. Between time T1 to T2, the offset power provider 62 updates the $POF=f\{\Sigma(\Delta V_S-\Delta Vref)\}$ at an interval of 32 milliseconds such that the target power generator 51 correspondingly updates the target lamp power PTG, assuring to constantly correcting the reference lamp power Pref in an exact reflectance of the monitored lamp condition. Also, between time T2 to T3, the target power generator 51 updates the target power every 32 milliseconds to approach the target lamp power gradually to the reference lamp power. With this scheme of constantly updating the target lamp power PTG, the lamp 30 having the characteristic curve β or γ is allowed to increase the luminous flux along a curve closer to the curve α, as indicated by thin dotted lines in FIG. 2B. In other words, the lamp the characteristic curve β or γ is modified to become as closer as possible to the curve α, as indicated by arrows in FIG. 2B, enabling the lamp to reach the stabilized luminous flux level in the same time irrespective of the lamp characteristic variations.

In the illustrated embodiment, time T1 is determined by the sum of the output power having been supplied to the lamp, in view of the finding that the deviation of the lamp characteristic becomes critical enough for correcting the reference lamp power only after the luminous flux begins increasing continuously towards the stabilized level, i.e., a certain amount of the output power has been supplied to the lamp. For this purpose, the controller 40 includes a discriminator 70 composed of a lamp power integrator 71 and a lamp power sum provider 72. The lamp power integrator 71 integrates the instantaneous lamp power obtained at the lamp power calculator 43 and outputs the sum of the lamp power that has been supplied to the lamp. The resulting sum of the lamp power is compared at the comparator 73 with a predefined target lamp power sum given from the lamp power sum provider 72. The comparator 73 issues a trigger signal when the output of the lamp power integrator 71 exceeds the target lamp power sum. It is the trigger signal that enables the voltage deviation detector 61 such that the offset power provider 62 gives the offset power for correcting the reference lamp power Pref as discussed in the above. Although the illustrated scheme of determining the time T1 based upon thus monitored lamp power, it is equally possible to use an internal timer and to simply rely on the fixed time T1, for example, 2 seconds after the lamp start. Times T2 and T3 may be determined to be dependent upon or independently of time T1.

Further, the discriminator 70 includes a re-starting adjustor 81 which is reset each time upon detection of a no-load condition as a result of the lamp is either turned off or accidentally extinguished. The re-starting adjustor 81 acknowledges a downtime elapsed after the ballast goes into the no-load condition, and gives a hot-start signal indicative of the downtime to a starting lamp power adapter 82 and to the lamp power sum provider 72 at the time of re-starting the lamp 30. The starting lamp power adapter 82 is provided for adapting the reference lamp power to the change in the lamp characteristic that the hot lamp exhibits, i.e., reducing the initial lamp power to be supplied to the lamp to a larger extent and shorting a time of supplying the initial lamp power as the downtime decreases. Thus adapted reference lamp power is fed to the reference lamp power table 50 to update the reference lamp power Pref stored therein in compensation for the lamp characteristic change. At the same time, the lamp power sum provider 72, in response to the hot-start signal, operates to lower the target lamp power sum in balance with the downtime, thereby reducing time T1 to hasten the activation of the voltage deviation detector 61 for correcting the reference lamp power Pref when restarting the hot lamp. The starting lamp power adapter 82 and the lamp power sum provider 72 are made active to alter the reference lamp power sum and the target lamp power, respectively in accordance with the downtime. In order to acknowledge the downtime, the adjustor 81 may adopt a suitable timer circuit or its equivalent that is reset to count the downtime upon detection of the lamp's extinction. The re-starting adjustor 81 may include any suitable one of various known circuits for detection of the no-load condition, for example, in terms of the output voltage being supplied to the lamp.

It is true that there is an inevitable variation in the lamp starting characteristic even among the lamps of the same rated power. Taking this into consideration, the controller 40 is designed to give the reference lamp power Pref which is selected for one of the lamps that has a lowest speed of increasing the luminous flux. Thus, the ballast can define a maximum output power corresponding to the lamp characteristic of the lamp having the lowest luminous flux increasing speed, assuring not to generate excessive output power to the lamps having the higher luminous flux increasing speed. When the reference lamp power Pref is set to increase the luminous flux of the lamp having the lowest speed of increasing the luminous flux such that the luminous flux increases 25% to 150% of the standard level at one (1) second from the start of the lamp, and 80% to 130% of the standard level within 1 to 4 seconds from the start of the lamp, the reference lamp voltage Vref is set to be follow a voltage curve when the lamp is supplied with the reference lamp power Pref. Thus, for operating the other lamps having the higher speeds, it is not necessary for the ballast to increase the target lamp power beyond the above reference power Pref. That is, the target lamp power can be always below the reference lamp power Pref obtained for the lamp having the lowest luminous flux increasing speed. With this result, the maximum lamp power can be determined in direct relation with the lamp reference power Pref, while taking into consideration of an allowable lamp power, not only an instantaneous lamp power but also a time integral of the lamp power being supplied to advance the lamp to the stabilized condition. As the maximum lamp power can be set in direct relation to the reference lamp power, i.e., set to a fixed value, it is easy to select various parts of the ballast based upon their performances in concordance with the maximum lamp power. Also, since the ballast can be given only one maximum lamp power while permitting to successfully control the lamp having the same rating but exhibiting different lamp characteristics, the target lamp power obtained by the controller for the lamps of the higher luminous flux increasing speed can limited to and never exceed the maximum lamp power even in the presence of noise, for protecting the ballast as well as the lamp. In addition, the offset power POF can not be made negative, which makes it easy to execute PTG=Pref−POF for simplifying the corresponding processing.

In this connection, the target power generator 51 includes a limiter for limiting the target power between the maximum lamp power and the rated lamp power. For this purpose, the target power generator 51 is programmed to execute a sequence of FIG. 3, in which the target lamp power PTG is compared with the rated lamp power as well as the maximum lamp power given to the ballast. When the target lamp power PTG is found to less than the rated lamp power PRT, the target lamp power PTG is set to be equal to the rated lamp power PRT. Also, when the target lamp power PTG is found to exceed the maximum lamp power PMX, PRT is set to be equal to PMX. Further, in order to give the offset power POF in exact reflectance of the deviation in the detected lamp voltage and therefore make the resulting target lamp power PTG free from possible noises which would otherwise give abrupt change in the target lamp power, the offset power provider 62 includes a correction limiter 66 for limiting the offset power POF from varying beyond a predetermined extent. As shown in FIG. 4, the offset power provider 62 also includes a function generator 65 that provides a correction power $PCR=f\{\Sigma_i(\Delta VS_i-\Delta Vref)\}$ in exact reflectance of the ever updating voltage correction index $VCR=\Sigma_i(\Delta VS_i-\Delta Vref)$ from the voltage deviation detector 61. Then, the correction power PCR is evaluated in comparison with a variable PB corresponding to the immediately previous offset power POF so as to validate the fresh offset power POF in a manner as explained in FIG. 5.

Figure 3:
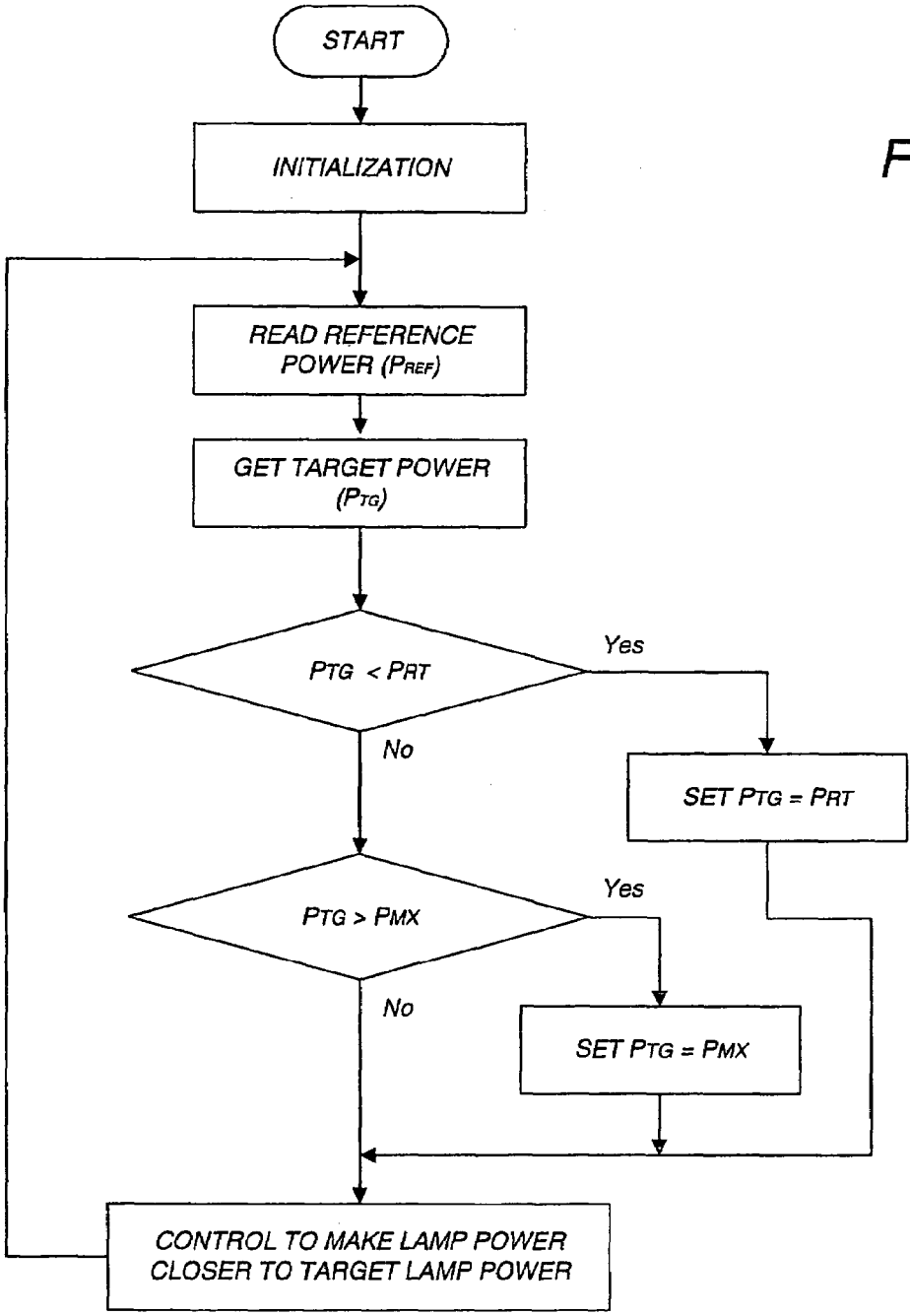
FIG. 3 is a flow chart illustrating a control sequence of the above ballast.
Figure 5:
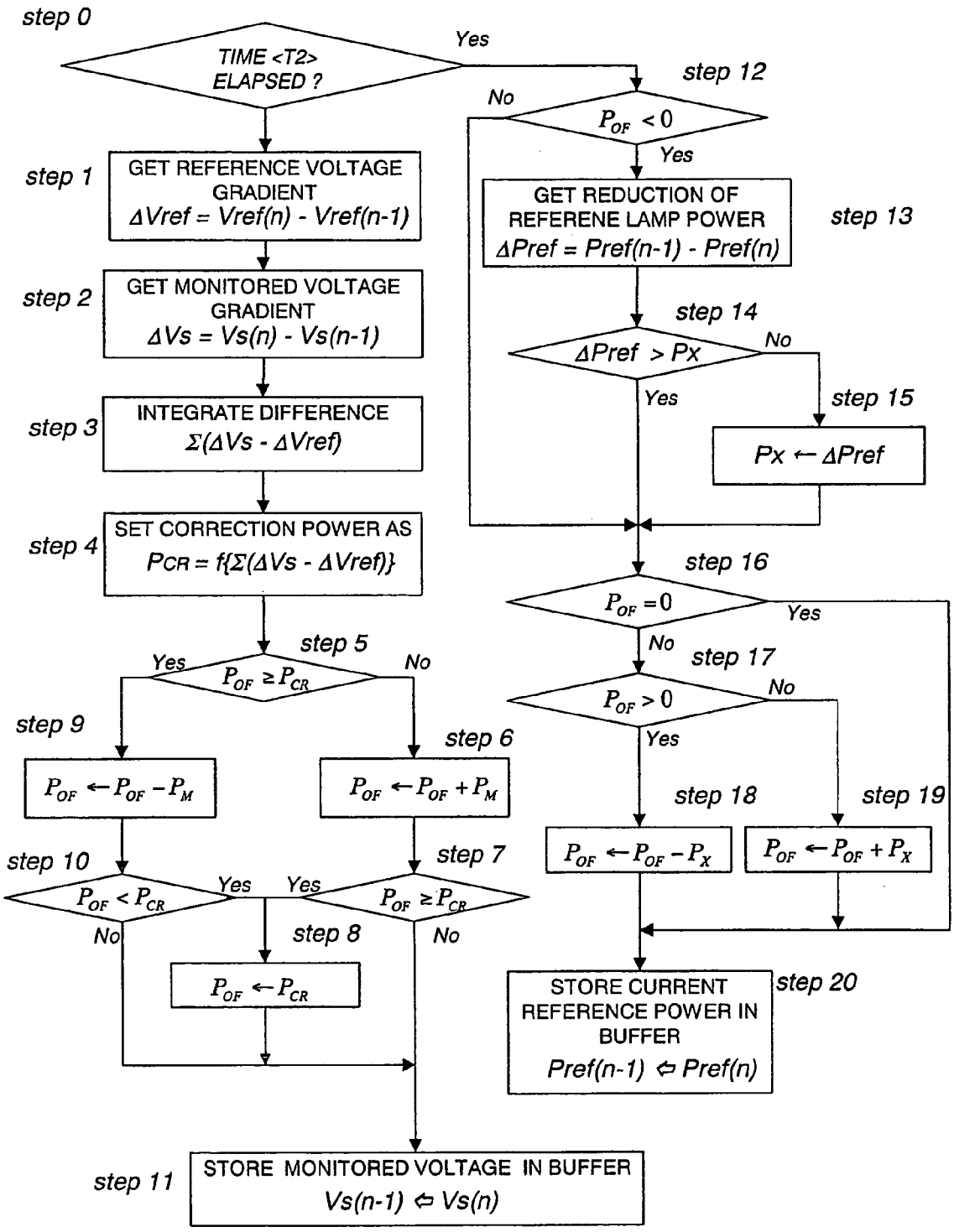
FIG. 5 is a flow chart illustrating power correction sequences of the above ballast

FIG. 5 shows a flow chart illustrating a power correction sequence which interrupts the sequence of FIG. 3 after the elapse of time T1. Until time T2, steps 1 to 11 are repeated every 32 milliseconds to determine the fresh offset power POF. After the correction power $PCR=f\{\Sigma_i(\Delta VS_i-\Delta Vref)\}$ is calculated through the steps 1 to 4, PCR is firstly compared with the immediately previous POF at step 5 to see whether a directly expected next offset power (i.e., PCR obtained at step 4) is equal to or less than the immediately previous offset power.

If POF<PCR, i.e., PCR obtained at step 4 becomes greater than the previous offset power (POF) and therefore the target lamp power would vary to a greater extent, POF is reset to be POF plus PM, a fixed value, at step 6. Then, thus incremented POF is again compared with the correction power PCR at step 7 to see whether or not the incremented POF is equal to or still above the correction power PCR. If POF≧PCR, i.e., the next expected offset power would be still above the correction power, PCR, i.e., the lower one of POF and PCR, is assigned to the next offset power (POF=PCR) at step 8. If the incremented POF<PCR at step 7, i.e., the next expected offset power would increase to an admissible extent of PM, POF is validated as the next offset power On the other hand, if it is judged at step 5 that PCR≦POF, i.e., the next expected offset power remains unchanged or decreases, POF is reset to be POF minus PM at step 9. Then, the decremented POF is again compared with the correction power PCR at step 10 to see whether the decremented POF goes below PCR. If PCR is above POF, i.e., the next expected offset power would decrease by an admissible extent and the resulting target power will not decrease excessively, POF is validated as the next offset power. IF POF<PCR, i.e., the next expected offset power would decrease to an inadmissible extent, POF is reset to be equal to PCR, the higher one of POF and PCR at step 8, followed by being validated as the next offset power. Also in the course of decreasing the offset power, the next offset power POF can be limited to decrease to an extent not greater than PM.

Turning-back to step 0, when time T2 has elapsed, the controller 40 switches to another sequence of converging the target lamp power PTG towards the reference lamp power Pref gradually until time T3. That is, the sequence is programmed to reduce the offset power POF gradually to zero until time T3, rather than calculating the offset power POF based upon the voltage correction index VCR. Firstly, it is checked at step 12 whether or not the next offset power POF is negative. When negative, i.e., the next target lamp power PTG would increase, the sequence goes to step 13 where it is made to get a reduction of reference lamp power Pref by subtracting an instantaneous current lamp power from a previous lamp power (ΔPref=Pref(n−1)−Pref(n)). The reduction (ΔPref) is then compared at step 14 with a correction factor Px indicative of a normally expected decrement of the lamp power.

If ΔPref>Px, i.e., the lamp power have to decrease by an extent larger than the correction factor and the next offset power POF is negative, the sequence goes through steps 16 and 17 to step 19 so that the next offset power POF is incremented by Px. If ΔPref>Px is not satisfied and at the same time POF is negative, the sequence goes to step 15 where Px is reset to be equal to ΔPref such that the decrement Px is reset to be equal to or reduced to ΔPref, after which POF is incremented by Px at step 19. When, on the other hand, POF is found at step 12 to be positive, the sequence jumps to step 18 where the next offset power POF is decremented by Px. In this manner, the sequence starting from step 12 assures to gradually decrease or converge the resulting target lamp power PTG to the reference lamp power, as shown in FIG. 2F. Thus, it is possible to avoid any abrupt change in the lamp power being supplied to the lamp and therefore avoid undesired overshooting of the luminous flux or unintended lamp extinction. The above sequence repeats every 32 milliseconds, as interrupting the main control sequence of FIG. 3, to constantly update the target lamp power.

Figure 6:
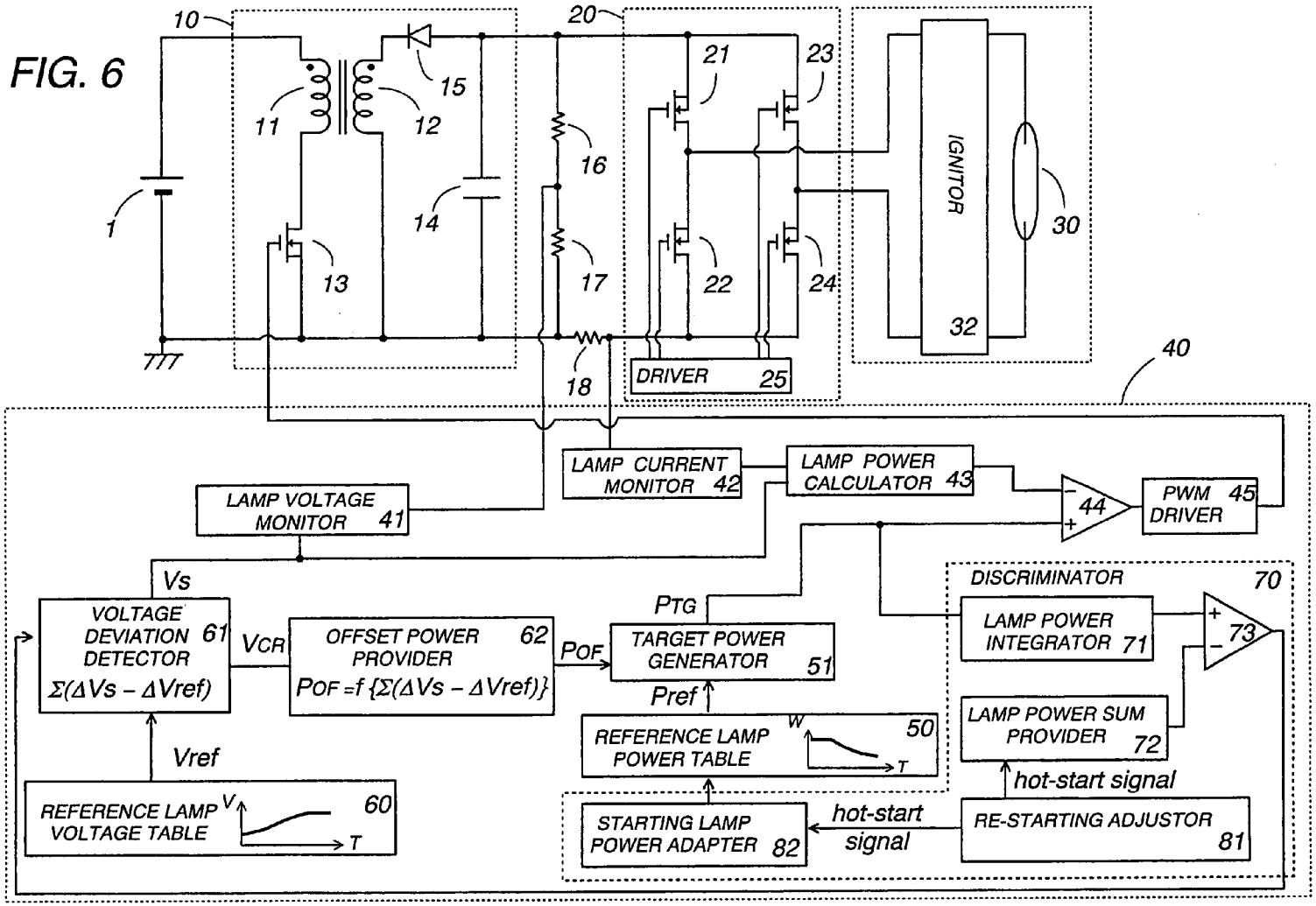
FIGS. 6 to 8 are circuit diagrams respectively illustrating various modifications of the above ballast.

FIG. 6 illustrates a modified ballast which is identical to the first embodiment except that the lamp power integrator 71 takes the current lamp power from the target power generator 51 and give the integrated lamp power in order to determine time T1 for initiating the power correction control. Like parts are designated by like reference numerals, and no duplicate explanation is deemed necessary.

Figure 7:
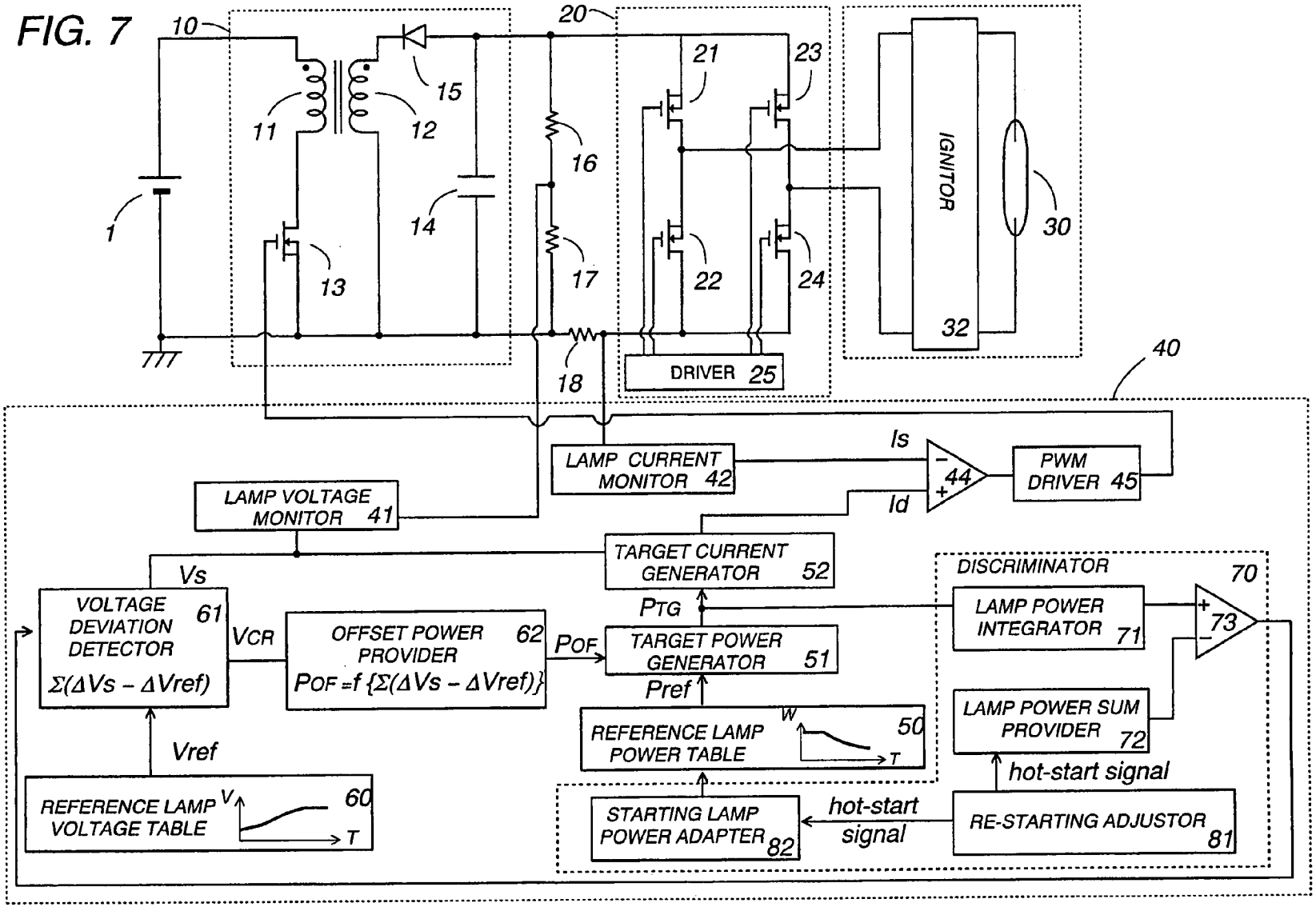

FIG. 7 illustrate another modification of the ballast which is identical to the first embodiment except that a target current generator 52 is included in the controller 40 for making a current-based control of regulating the output power being supplied to the lamp 30. The target current generator 52 provides a target current Id by dividing the target lamp power PTG by the monitored lamp voltage Vs. The error amplifier 44 receives the target current Id as well as the monitored lamp current Is and activates PWM driver 45 for varying the output power of the converter 10 in match with the target lamp power. Like parts are designated by like reference numerals, and no duplicate explanation is deemed necessary.

Figure 8:
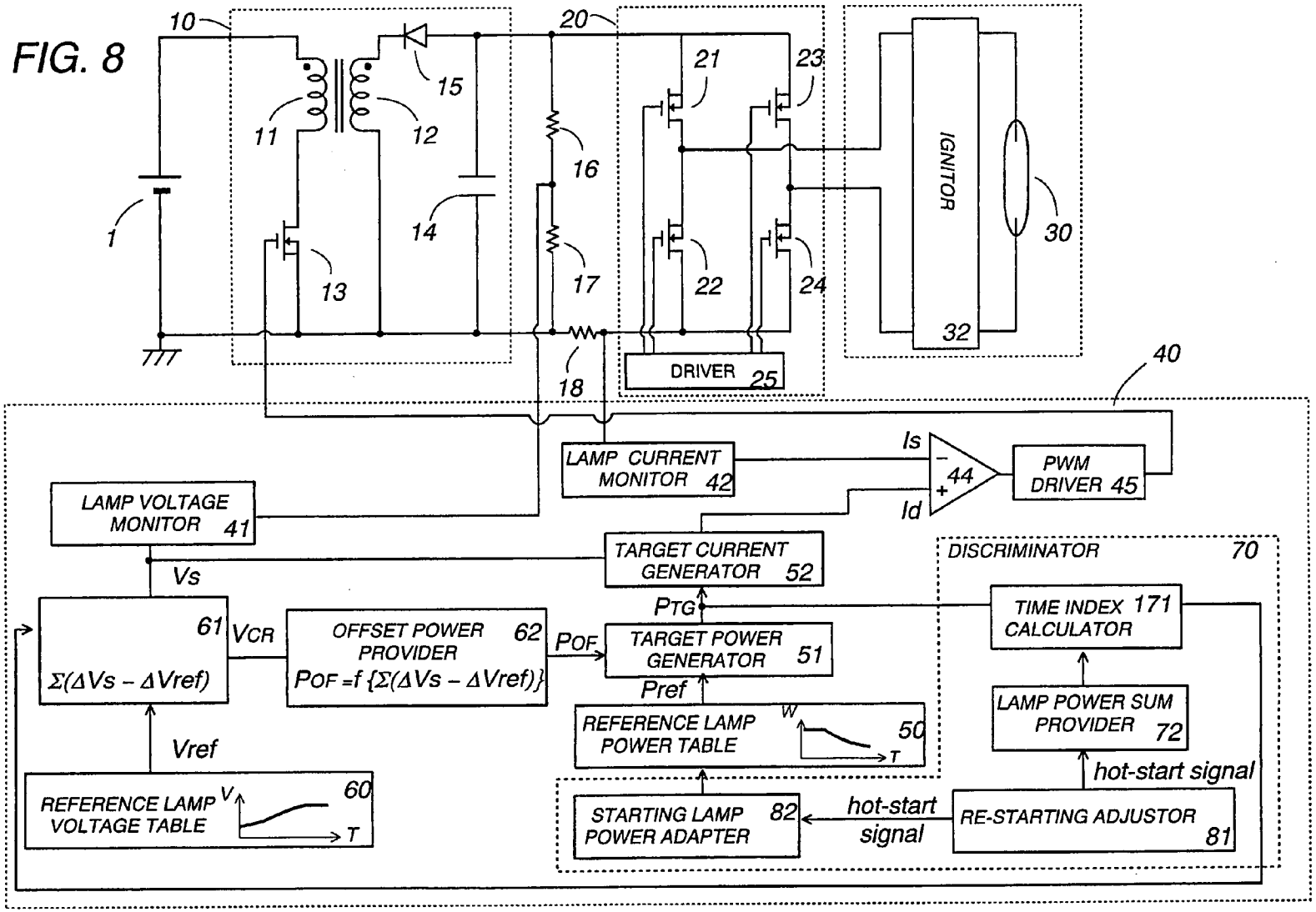

FIG. 8 illustrates a further modification of the ballast which is identical to the first embodiment except that the target current generator 52 is included in the controller 40 for making the current-based control of regulating the output power, and also that the discriminator 70 includes a time index calculator 171 which gives the trigger signal for determining time T1, i.e., the starting of the power correction. Like parts are designated by like reference numerals. The time index calculator 171 fetches the target lamp power sum from the lamp power sum provider 72, and divides the lamp power sum by the target lamp power PTG to give a time index indicative of time T1. When the elapsed time after the start of the lamp, which is counted by an internal timer, reaches the time index, the time index calculator 171 issues the trigger signal to activate the voltage deviation detector 61 for initiating the power correction. It is also noted in this connection that the lamp power sum is set to vary in accordance with the hot start signal, i.e., downtime from the re-starting adjustor 81 in the same manner as discussed herein above with reference to the first embodiment, assuring to make the hot-starting of the lamp successfully.

Figure 9:
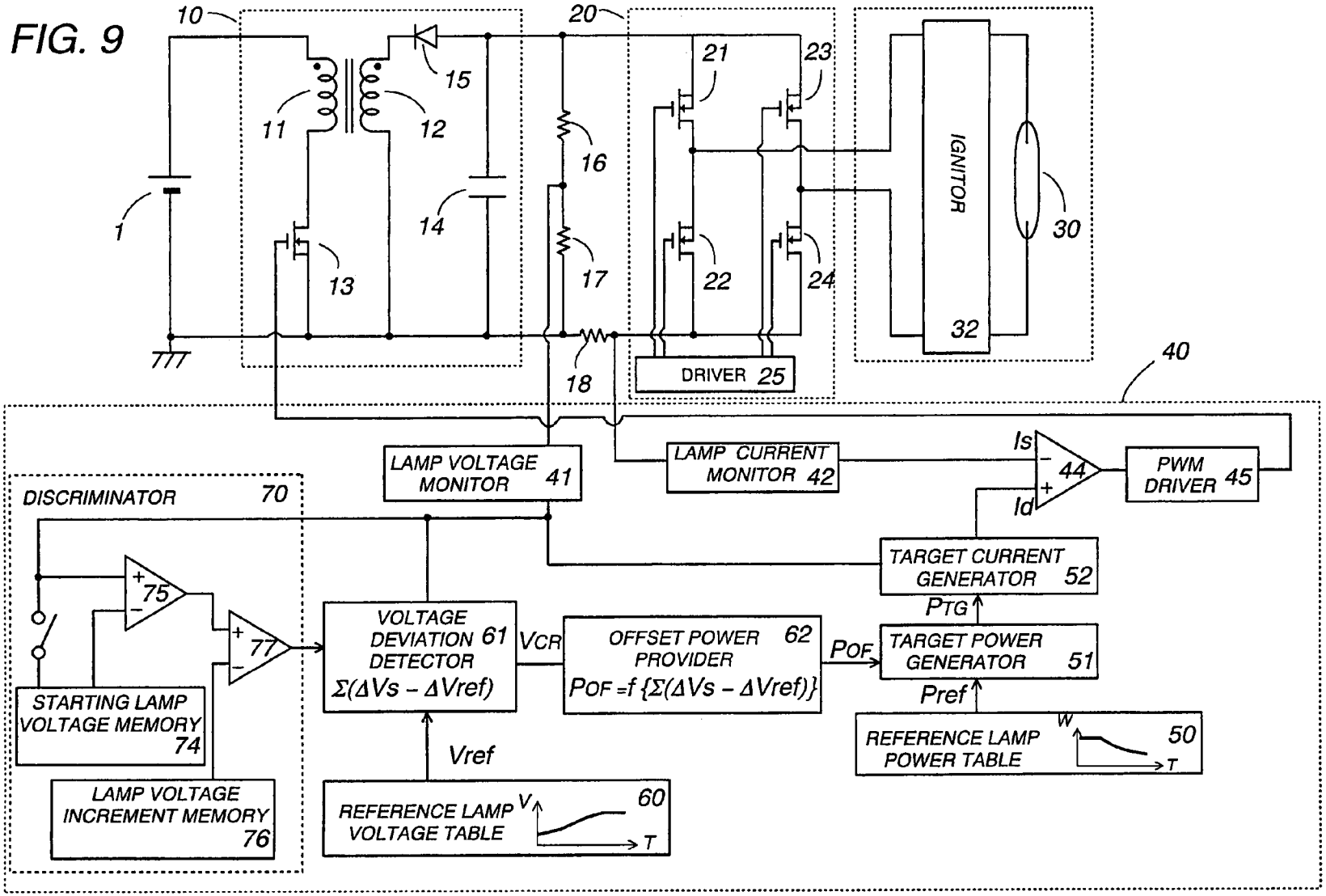
FIG. 9 is a circuit diagram of an electronic ballast in accordance with a second embodiment of the present invention.

FIG. 9 illustrates an electronic ballast of a second embodiment of the present invention which is basically identical to the modifications of the first embodiment except that the discriminator 70 is configured to determine time T1 of initiating the power correction by monitoring the lamp voltage Vs. Like parts are designated by like reference numerals. The discriminator 70 includes a starting lamp voltage memory 74 that stores an initial lamp voltage monitored to be applied to the lamp 30, a subtracter 75 that provides the voltage difference between the current lamp voltage being monitored and the initial lamp voltage, and a lamp voltage increment memory 76 storing a critical voltage increment. When voltage difference is found at a comparator 77 to exceed the critical voltage increment, the trigger signal is fed to the voltage deviation detector 61, activating the associated units for initiating the power correction, as discussed with reference to FIGS. 2A to 2F.

Figure 10:
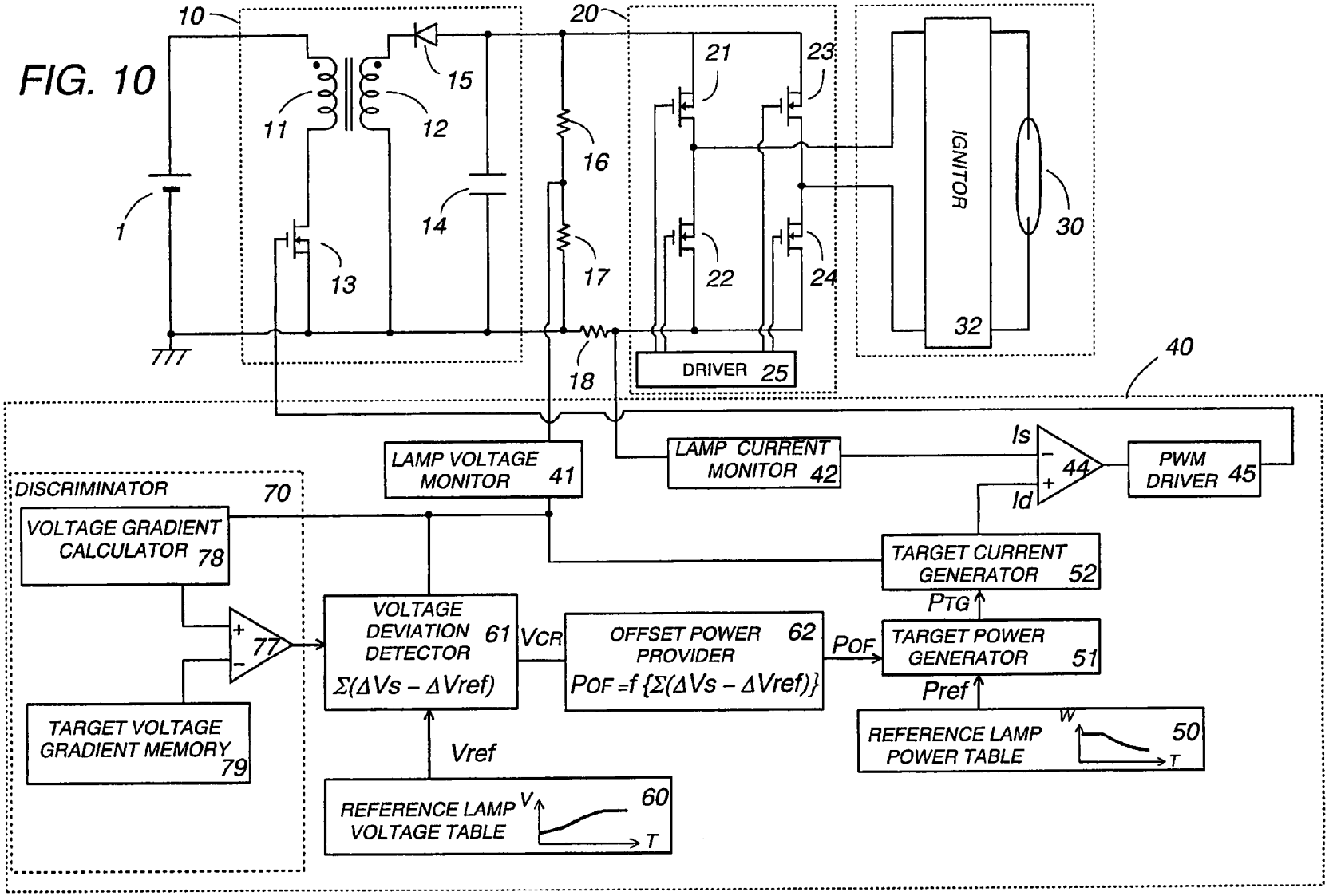
FIG. 10 is a circuit diagram illustrating a modification of the second embodiment.
Figure 12A:
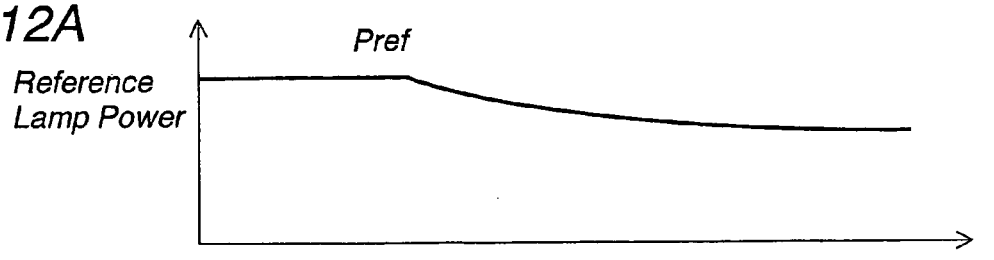
FIGS. 12A to 12F are respectively waveform charts illustrating the operation of the modified ballast.
Figure 12B:
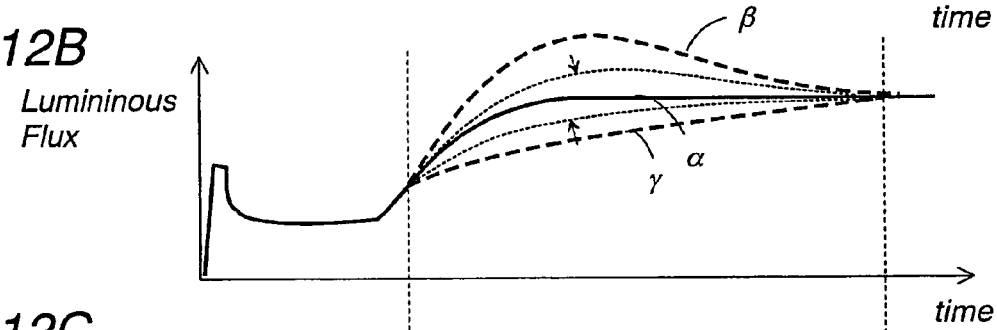
Figure 12C:
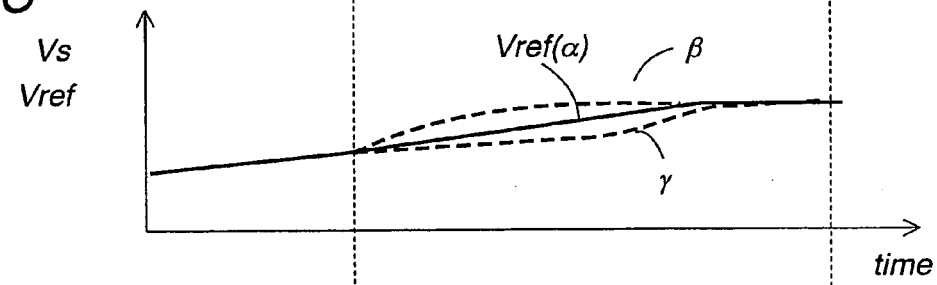
Figure 12D:
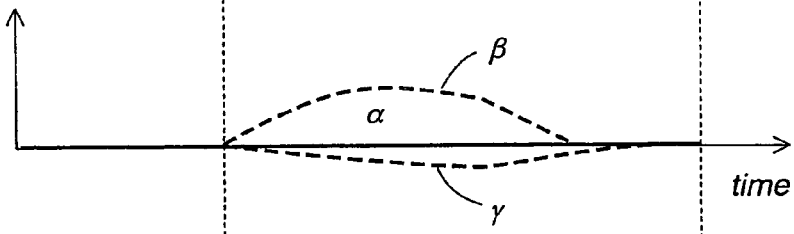
Figure 12E:
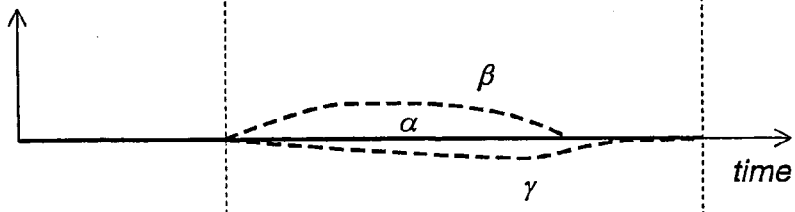
Figure 12F:
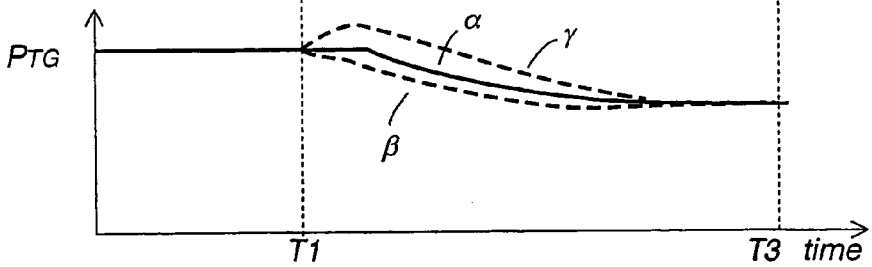

FIG. 10 illustrates a modified ballast which is identical to the second embodiment except that the discriminator 70 decides time T1 by checking a gradient of the lamp voltage being monitored. Like parts are designated by like reference numerals. The discriminator 70 includes a voltage gradient calculator 78 which gives the lamp voltage gradient, and a target voltage gradient memory 79 storing a target gradient. When the instant lamp voltage gradient exceeds the target gradient, the comparator 77 issues the trigger signal for initiating the power correction and therefore defining time T1.

In the above embodiments and modifications, the discriminator 70 is illustrated in combination with the sophisticated power correction control as shown in FIGS. 2A to 2F. However, the specific schemes of determining the timing T1 disclosed herein could be utilized in combination with a simple scheme of reducing the lamp power after time T1, and accordingly could constitute a subject matter not limited to the sophisticated power correction control disclosed herein. Particularly for the mercury-free discharge lamp, the above schemes of determining timing T1 is found most effective, since the time T1 thus obtained is well coincident with a timing after which the luminous flux will increase with the deceasing lamp power.

Also in the above embodiments and modifications, the voltage deviation detector 61 is shown to provide the voltage correction index $VCR=\sum_t(\Delta Vs-\Delta Vref)$, it may be simply designed to provide VCR=Vs−Vref, or any other value that reflects the deviation between the monitored lamp voltage Vs and the reference lamp voltage Vref at the varying time. When the voltage correction index (VCR=Vs−Vref) is selected, the offset power provider 62 can be arranged to give the offset power defined POF=f{(Vs−Vref)}.

Irrespective of how the voltage correction index VCR is calculated, it is found effective to restrict the varying rate of the offset power POF, as shown in FIG. 11. That is, the offset power provider 62 may be configured to lower its gradient of increase as the voltage correction index VCR increase. With this arrangement, the offset power POF increases at a higher rate when the voltage correction index VCR becomes first appreciable, and increases at a lower rate when VCR becomes large. This means that the resulting target lamp power can be adequately lowered at T1 immediately following such increase of the luminous flux that would certainly bring about overshooting if the lamp power is not lowered, and that the target lamp power can be free from being lowered excessively after the lamp power is caused to decrease, assuring to avoid accidental extinction of the lamp.

Further, it is noted that the present invention should not be limited to the above control scheme of using time T2 after which the offset power provider 62 gives the gradually reducing absolute value of the offset power POF not on the basis of the voltage correction index VCR, and therefore the present invention should encompass a control scheme in which the offset power provider 62 gives the offset power POF on the basis of the voltage correction index VCR until time T3 where the luminous flux converges to the stabilized level, as shown in FIGS. 12A to 12F. In the figures, like reference marks are utilized for easy comparison between the characteristics of FIGS. 2A to 2F and FIGS. 12A to 12F.

The individual features disclosed herein may be suitably combined to constitute any other modifications which are within the scope of the present invention.

This application is based upon and claims the priorities of Japanese Patent Application No. 2002-279980, filed in Japan on Sep. 25, 2002, and No. 2003-185856, filed in Japan on Jun. 27, 2003, the entire contents of which are expressly incorporated by reference herein.

What is claimed is:

1. An electronic ballast for a discharge lamp comprising:

a power converter that provides a regulated output power for operating said discharge lamp, a lamp voltage monitor that monitors a lamp voltage being applied to said lamp from said power converter;

a lamp current monitor that monitors a lamp current being supplied to said lamp from said power converter;

a controller that regulates said power converter to vary said output power in accordance with said lamp voltage and lamp current being monitored, wherein said controller comprises:

a lamp voltage table specifying a reference lamp voltage to be applied to said lamp, said reference voltage being defined to vary with respect to time elapsed from the start of said lamp;

a voltage deviation detector that obtains a voltage-related deviation between said lamp voltage being monitored and said reference voltage corresponding to a time at which said lamp voltage is monitored, in order to give a voltage correction index indicative of said voltage-related deviation, an offset power provider that processes said voltage correction index to give an offset power varying with time, a lamp power table specifying a reference lamp power to be supplied to said lamp, said reference lamp power being defined to vary with respect to time elapsed from the start of said lamp;

a target power generator that corrects said reference lamp power into a target lamp power in view of said offset power in accordance with an on-time basis, and a commander that provides a control command for regulating said output power in match with said target lamp power, said voltage deviation detector updating said voltage correction index over a plurality of times until a luminous flux of said lamp converges to a certain level, said target power generator updating said target lamp power in correspondence with said updated voltage correction index.

2. The electronic ballast as set forth in claim 1, wherein said voltage deviation detector calculates said voltage-related deviation ($\Delta V_S - \Delta Vref$) between a gradient of said monitored lamp voltage ($\Delta Vs$) and a gradient of said reference lamp voltage ($\Delta Vref$) with respect to time, and obtains said voltage correction index (VCR) which is an integral of said deviation defined by $VCR = \Sigma(\Delta V_S - \Delta Vref)$, said offset power provider provides said offset power that is a function of said voltage correction index as expressed by $POF = f\{\Sigma(\Delta V_S - \Delta Vref)\}$, said target power generator providing said target power (PTG) which is said reference lamp power (Pref) minus said offset power (PTG=Pref−POF).

3. The electronic ballast as set forth in claim 1, wherein said voltage deviation detector gives said voltage correction index (VCR) defined by an error voltage (Vs−Vref) between said monitored lamp voltage (Vs) and said reference lamp voltage (Vref), and wherein said offset power provider provides said offset power that is a function of said voltage correction index as expressed by $POF = f\{(V_S - Vref)\}$, said target power generator providing said target lamp power (PTG) which is said reference lamp power (Pref) minus said offset power (PTG=Pref−POF).

4. The electronic ballast as set forth in claim 2 or 3, wherein said controller has a function of reducing a gradient of said offset power as said voltage correction index increases.

5. The electronic ballast as set forth in claim 2 or 3, wherein said controller reduces the absolute value of said offset power as the time elapses beyond a predetermined time period from the start of the lamp.

6. The electronic ballast as set forth in claim 5, wherein said controller operates not to increase the output power after the elapse of said predetermined time period.

7. The electronic ballast as set forth in claim 1, wherein said controller includes an output limiter that increases the output power up to a rated lamp power when said target lamp power is corrected to be less than said rated lamp power.

8. The electronic ballast as set forth in claim 1, wherein said controller includes an output limiter that limits the output power below a maximum lamp power when said target lamp power is corrected to exceed said maximum lamp power.

9. The electronic ballast as set forth in claim 1, wherein said controller includes a correction limiter that limits said offset power from varying beyond a predetermined extent.

10. The electronic ballast as set forth in claim 1, wherein said target power generator starts operating to correct said reference lamp power after an elapse of a predetermined time from the start of operating the lamp.

11. The electronic ballast as set forth in claim 1, wherein said controller includes a discriminator which examines a parameter indicative of the luminous efficacy of said lamp and issues a trigger signal when said parameter satisfies a predetermined criterion indicative of that said luminous efficacy of said lamp increases to a certain level, and wherein said target power generator correcting said reference lamp power upon occurrence of said trigger signal.

12. The electronic ballast as set forth in claim 11, wherein said discriminator integrates a lamp power being supplied to said lamp from the start of operating said lamp to give an integrated lamp power, and wherein said criterion is whether said integrated lamp power exceeds a predetermined value such that said discriminator issues said trigger signal when said integrated lamp power exceeds said predetermined value.

13. The electronic ballast as set forth in claim 11, wherein said discriminator integrates a target lamp power intended to be supplied from the start of operating said lamp to give an integrated lamp power, and wherein said criterion is whether said integrated lamp power exceeds a predetermined value such that said discriminator issues said trigger signal when said integrated lamp power exceeds said predetermined value.

14. The electronic ballast as set forth in claim 11, wherein said discriminator has a target lamp power sum which a time integral of the target lamp power, said discriminator dividing said target lamp power sum by an instantaneous lamp power intended to be supplied to said lamp to obtain a time index, said criterion is whether said time index is exceeded by an elapsed time after the start of the lamp such that said discriminator issues said trigger signal when said time index is exceeded by said elapsed time.

15. The electronic ballast as set forth in any one of claims 12 to 13, wherein said discriminator includes a re-starting adjustor which gives an index of a downtime starting from the extinction of said lamp, said predetermined value decreasing with the decreasing downtime.

16. The electronic ballast as set forth in claim 14, wherein said discriminator includes a re-starting adjustor which gives an index of a downtime starting from the extinction of the lamp, said target integrated lamp power decreasing with the decreasing downtime.

17. The electronic ballast as set forth in claim 11, wherein said discriminator gives a voltage difference between a current lamp voltage being monitored and a starting lamp voltage monitored at the start of operating the lamp, and wherein said criterion is whether said voltage difference is greater than a predetermined voltage such that said discriminator issues said trigger signal when said voltage difference becomes greater than said predetermined voltage.

18. The electronic ballast as set forth in claim 11, wherein said discriminator gives a gradient of said lamp voltage being currently monitored, wherein said criterion is whether said gradient is greater than a predetermined value such that said discriminator issues said trigger signal when said gradient becomes greater than said predetermined value.

* * * * *